US009918569B1

(12) United States Patent
Abel

(10) Patent No.: US 9,918,569 B1
(45) Date of Patent: Mar. 20, 2018

(54) FOUR SIDE SHOPPABLE QUICK ASSEMBLING DISPLAY HUTCH

(71) Applicant: Sonoco Development, Inc., Hartsville, SC (US)

(72) Inventor: Patrick Abel, Crescent Springs, KY (US)

(73) Assignee: Sonoco Development, Inc., Hartsville, SC (US)

( * ) Notice: Subject to any disclaimer, the term of this patent is extended or adjusted under 35 U.S.C. 154(b) by 0 days.

(21) Appl. No.: 15/373,925

(22) Filed: Dec. 9, 2016

(51) Int. Cl.

| | |
|---|---|
| ***A47B 5/00*** | (2006.01) |
| ***A47B 43/02*** | (2006.01) |
| ***A47F 5/11*** | (2006.01) |
| ***B65D 5/52*** | (2006.01) |
| ***A47B 47/06*** | (2006.01) |
| ***A47B 55/06*** | (2006.01) |

(52) U.S. Cl.
CPC ..... *A47F 5/116* (2013.01); *A47B 43/02* (2013.01); *A47B 47/06* (2013.01); *A47B 55/06* (2013.01); *A47F 5/112* (2013.01); *B65D 5/5213* (2013.01)

(58) Field of Classification Search
CPC ..... A47F 5/116; A47F 5/112; A47F 5/114; A47F 5/0018; A47B 43/02; A47B 47/06; A47B 43/00; B65D 5/5213; B65D 5/526
See application file for complete search history.

(56) References Cited

U.S. PATENT DOCUMENTS

| | | | | |
|---|---|---|---|---|
| 4,618,115 | A * | 10/1986 | Belokin, Jr. | A47F 5/116 211/135 |
| 4,630,740 | A * | 12/1986 | Belokin, Jr. | A47F 5/116 211/194 |
| 4,854,246 | A * | 8/1989 | Belokin | A47F 5/116 108/162 |
| 5,183,166 | A * | 2/1993 | Belokin, Jr. | A47F 5/116 211/130.1 |
| 5,213,220 | A * | 5/1993 | McBride | A47B 43/00 211/126.16 |
| 7,677,433 | B2 | 3/2010 | Little | |
| 7,703,864 | B2 | 4/2010 | Moser | |
| 8,157,112 | B2 * | 4/2012 | Bojie | A47F 5/11 211/135 |
| 8,485,370 | B2 * | 7/2013 | Dewhurst | A47F 5/116 211/135 |
| 8,627,585 | B2 * | 1/2014 | Herman Baran | A47F 5/112 108/162 |
| 8,857,633 | B2 * | 10/2014 | Dewhurst | A47F 5/116 211/135 |
| 8,875,908 | B2 * | 11/2014 | L'Hotel | A47F 5/116 211/135 |
| 2010/0006529 | A1 * | 1/2010 | Groff | A47F 5/116 211/186 |
| 2012/0305512 | A1 * | 12/2012 | L'Hotel | A47F 5/116 211/198 |
| 2017/0245661 | A1 * | 8/2017 | Heuer | A47B 43/00 |

* cited by examiner

*Primary Examiner* — Daniel J Troy
*Assistant Examiner* — Kimberley S Wright
(74) *Attorney, Agent, or Firm* — Miller, Matthias & Hull LLP

(57) ABSTRACT

A display hutch is provided that can be made from three components adhered together to form a flat compact structure suitable for shipping. The compact structure can be positioned upright and converted into the display hutch by pushing down on support halves and by rotating inwardly shelf panels.

11 Claims, 10 Drawing Sheets

FOUR SIDE SHOPPABLE QUICK ASSEMBLING DISPLAY HUTCH

BACKGROUND OF THE INVENTION

Field of the Invention

This disclosure relates to a display hutch. More particularly, this disclosure relates to a display hutch made from three die cut blanks adhered together to form a flat compact structure suitable for shipping. The compact structure can be positioned upright and quickly converted into a display hutch by pushing down on two support members and individual shelf members.

Description of the Related Art

Floor stands (a.k.a. display hutches) having multiple shelves for supporting products are well known. Typically display hutches are made of multiple components and sometimes even require fasteners. Display hutches can also require complex assembly steps, and can be large even when knocked down. The present disclosure is designed to solve these problems.

BRIEF SUMMARY OF THE INVENTION

The present disclosure relates to a display hutch that can be made from three components adhered together to form a flat compact structure suitable for shipping. The compact structure can be positioned upright and converted into the display hutch by pushing down on support halves or by rotating inwardly (as by pushing) side shelf panels and then pushing down on front and rear shelf panels.

In one aspect a display hutch is disclosed comprising a front panel, a left side panel, a right side panel, a rear panel, one or more shelves and an internal support. The front panel comprises a front panel body that defines a plurality of windows and one or more front shelf panels rotatably attached to the front panel body along front shelf fold lines. The front panel extends from a left front corner edge to a right front corner edge. The left side panel extends from the left front corner edge to a left rear corner edge, and comprises a left side panel body and one or more left side shelf panels. Each left side shelf panel is rotatably attached to the left side panel body along a side shelf fold line. The left side panel further comprises a left side glue tab hingedly attached to each left side shelf panel along a glue tab fold line. The right side panel extends from the right front corner edge to a right rear corner edge, and comprises a right side panel body and one or more right side shelf panels. Each right side shelf panel is rotatably attached to the right side panel body along a side shelf fold line. The right side panel further comprises a right side glue tab hingedly attached to each right side shelf panel along a glue tab fold line. The rear panel extends from the left rear corner edge to the right rear corner edge and comprises a rear panel body that defines a plurality of windows and one or more rear shelf panels rotatably attached to the rear panel body along rear shelf fold lines. Each shelf may comprise one of the front shelf panels, one of the rear shelf panels and two of the side shelf panels. The internal support comprises left and right support halves. The left support half may be adhered to each left side glue tab and the right side support half may be adhered to each right side glue tab. The front panel, the left side panel, the right side panel, the rear panel and the shelves may be formed from a single folded unitary blank.

In another aspect a first blank is provided for making a display hutch. The first blank may comprise a front panel, a left side panel, a right side panel, a rear panel and shelf panels. The front panel may comprise a front panel body and one or more front shelf panels, each front shelf panel being attached to the front panel body along a front shelf fold line. The left side panel may be attached to the front panel along the left vertical edge and may comprise a left side panel body and one or more left side shelf panels, each left side shelf panel being hingedly attached to the left side panel body along a side shelf fold line. The left side panel may further comprise a left side glue tab hingedly attached to each left side shelf panel along a glue tab fold line. The right side panel may be attached to the front panel along the right vertical edge and may comprise a right side panel body and one or more right side shelf panels, each right side shelf panel being hingedly attached to the right side panel body along a fold line. The right side panel may further comprise a right side glue tab hingedly attached to each right side shelf panel along a glue tab fold line. The rear panel may be attached to one of the side panels along a vertical edge and may comprise a rear panel body and one or more rear shelf panels. Each rear shelf panel may be attached to the rear panel body along a rear shelf fold line. The front panel and the ear panel may be vertically bisected by a fold lines to allow the blank to folded into a compact shape. The blank may further comprise a glue panel foldably attached to a side panel or another panel.

In still another aspect a method of assembling a display hutch of the kind described herein is provided. The method may comprise the steps of: adhering a support half to the glue tabs of the left side panel and adhering the other support half to the glue tabs of the right side panel; adhering the glue panel to the rear panel to create a folded and glued structure; positioning the folded and glued structure in an upright position and squaring up the structure; rotating downwardly in unison the side shelf panels of each side panel along the side shelf fold lines until the support halves abut each other; rotating downwardly each front shelf panel about its front shelf fold line until each front shelf panel is in a horizontal orientation; and rotating downwardly each rear shelf panel about its rear shelf fold line until each rear shelf panel is in a horizontal orientation.

DETAILED DESCRIPTION OF THE INVENTION

Figure 1:
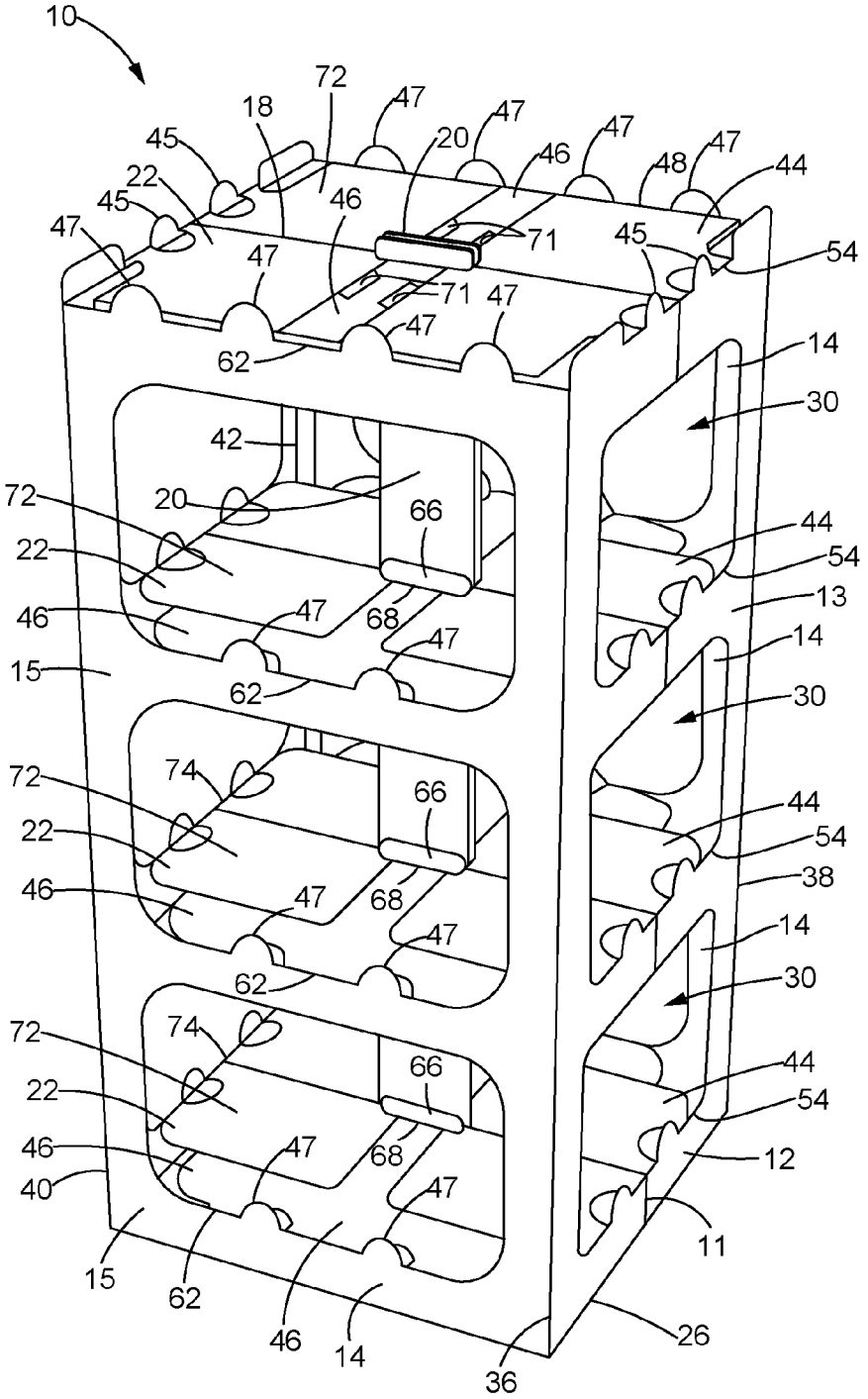
FIG. 1 is a perspective view of a display hutch according to the disclosure.

While the invention described herein may be embodied in many forms, there is shown in the drawings and will herein be described in detail one or more embodiments with the understanding that this disclosure is to be considered an exemplification of the principles of the invention and is not intended to limit the disclosure to the illustrated embodiments. Aspects of the different embodiments can be combined with or substituted for one another.

As will be appreciated, terms such as "above" and "below", "upper" and "lower", "left" and "right", "top" and "bottom," "front" and "back," (etc.), used as nouns, adjectives or adverbs refer in this description to the orientation of the structure of the hutch as it is illustrated in the various views. Such terms are not intended to limit the invention to a particular orientation.

Turning to the drawings, where like numerals indicate like elements, there is shown in FIG. 1 a perspective view of a display hutch 10 according to the disclosure. The hutch 10 comprises four major panels, that is, a front panel 12, two side panels 14 and a rear panel 16, as well as an internal support 20 and shelves 22. Each shelf 22 may have a load bearing surface and corresponds to a level. The hutch 10 shown in FIG. 1 has four levels, although the hutch 10 may be made with any number of levels.

The hutch 10 generally extends vertically (bottom to top) from a bottom edge 26 to a top edge 28. The various surfaces of the hutch 10, including the major panels, may bear graphics and other information about the products on display.

The hutch 10 may be a substantially rectilinear structure and has four vertical corner edges, namely, a left front corner edge 36, a right front corner edge 38, a left rear corner edge 40 and a right rear corner edge 42. The front panel 12 of the hutch 10 extends laterally from the left front corner edge 36 to the right front corner edge 38. The left side panel 14 extends front to back from the left front corner edge 36 to the left rear corner edge 40. The right side panel 14 extends front to back from the right front corner edge 38 to the right rear corner edge 42. And the rear panel 16 extends laterally from the left rear corner edge 40 to the right rear corner edge 42.

The front panel 12 comprises a front panel body 13 that defines a plurality of openings or windows 30 through which products may be seen and accessed. Each side panel 14 comprises a side panel body 15 may define a plurality of openings or windows 32 through which the products may be seen and accessed. The rear panel 16 comprises a rear panel body 17 that defines a plurality of openings or windows 30 through which products may be seen and accessed. Thus, the display hutch 10 may present four "shoppable" sides, that is, four sides through which products may be seen and accessed.

The front panel body 13 and the rear panel body 17 may include upwardly projecting front tabs 45 and rear tabs 45 at each level to help hold products or a tray full of products on the respective shelves 22. Likewise, each side panel body 15 may include upwardly projecting side tabs 47.

Each shelf 22 may comprise four separate panels: a front shelf panel 44, two side shelf panels 46 (obscured in FIG. 1 by the front shelf panels 44) and a rear shelf panel 72. Each front shelf panel 44 is hingedly connected to the front panel body 13 along a front shelf fold line 54 and may be supported at its distal (free) edge by the internal support 20. Each side shelf panel 46 is hingedly connected to a side panel body 15 along a side shelf fold line 62 and may be supported along its distal (free) edge 70 by the internal support 20. Each rear shelf panel 72 is hingedly connected to the rear panel body 17 along a rear shelf fold line 74 and may be supported at its distal (free) edge 76 by the internal support 20. Thus, each shelf 22 includes areas of double thickness and is supported by the front panel body 13, the side panel bodies 15, the rear panel body 17 and the internal support 20.

The internal support 20 is substantially long and narrow and extends vertically near the middle of the shelves 22. The internal support 20 is made from two blanks 88 and so is two layers thick. Each second blank 88 may be adhered to a side panel 14 and, more specifically, to glue tabs 66 that are hingedly affixed to every side shelf panel 46. As the display hutch 10 is erected, the two second blanks 88 come together in the middle of the structure to form the internal support 20. The second blanks 88, and thus the internal support 20, may define a series of vertically arranged notches 86 (better seen in FIG. 3) which may engage the front shelf panels 44 and the rear shelf panels 72 to lock them into a horizontal configuration as explained further below.

The internal support 20 may be located equidistant the front panel 12 and the rear panel 16 and equidistant the two side panels 14. Preferably the internal support 20 extends to the ground. In order to extend to the ground, each support half 88 may extend below the lowest glue tab 66 a distance equal to the distance from the lowest shelf 22 to the ground.

First Blank 50

Figure 2:
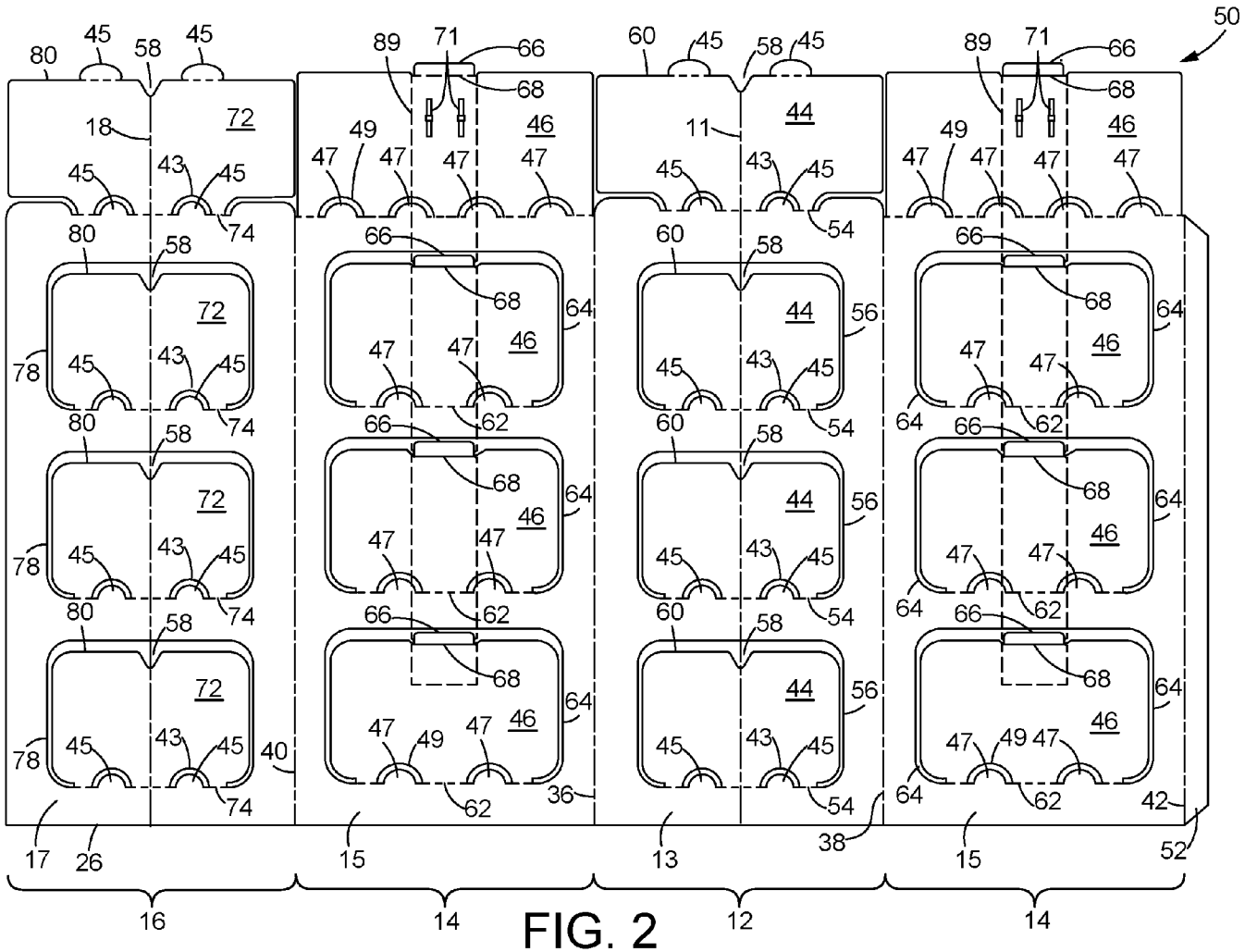
FIG. 2 is a plan view of a first blank used to make the display hutch of FIG. 1.

FIG. 2 is a plan view of a first blank 50 used to make the display hutch 10 of FIG. 1. The first blank 50 extends from a bottom edge 26 to a top edge 28 and comprises four major panels and a glue panel 52. The four major panels are the front panel 12, the two side panels 14 and the rear panel 16.

The front panel 12 is attached to one side panel 14 by a first fold line 36 corresponding to the left front corner edge 36 and to the other one side panel 14 by a second fold line 38 corresponding to the right front corner edge 38.

The left side panel 14 may be attached to the front panel 12 by the first fold line 36 corresponding to the left front corner edge 36 and to the rear panel 16 by a third fold line 40 corresponding to the left rear corner edge 40. The right side panel 14 may be attached to the front panel 12 by the second fold line 38 corresponding to the right front corner edge 38 and to the glue panel 52 by the fourth fold line 42 corresponding to the right rear corner edge 42 in the finished hutch 10.

Of course, other arrangements of the major panels are possible. The glue panel 52 may be foldably attached to any major panel and upon assembly of the hutch 10 may be affixed with glue or other adhesive to a different major panel. For example, the glue panel 52 may be foldably attached to the rear panel 16 and affixed to the right side panel 14. Also, the major panels can be arranged with both side panels 14 foldably attached to the rear panel 16. It should be understood that this disclosure is not limited to the particular panel arrangement shown in the drawings.

Still referring to FIG. 2, the front panel 12 comprises a ladder shaped front panel body 13 and one or more front shelf panels 44. Each front shelf panel 44 is attached to the front panel body 13 along a horizontal front shelf (fifth) fold line 54. Each front shelf panel 44 may be further defined by a substantially U-shaped cut line 56 that extends upwardly from one end of the front shelf fold line 54 to the opposite end. Each front shelf panel 44 may be substantially rectangular, and may define a (preferably V-shaped) cutout 58 centrally located along its distal (rear) edge 60, i.e., along the top portion 60 of the cut line 56. A front fold line (front knockdown score) 11 may vertically bisect the front panel 12.

Each side panel 14 may comprise a side panel body 15 and one or more side shelf panels 46. Each side shelf panel 46 may be attached to the side panel body 15 along a horizontal side shelf (sixth) fold line 62. At each level of the hutch 10, the side shelf fold lines 62 may be co-linear with the front shelf fold lines 54. The side shelf panels 46 may be further defined by U-shaped cut lines 64.

A glue tab 66 may be attached to each side shelf panel 46 along a glue tab fold line 68. The glue tabs 66 are configured to be adhered to the second blanks 88 as explained below.

The rear panel 16 includes a ladder shaped rear panel body 17 and one or more rear shelf panels 72. Each rear shelf panel 72 is attached to the rear panel body 17 along a horizontal rear shelf (sixth) fold line 74. Each rear shelf panel 72 may be further defined by a substantially U-shaped cut line 78 that extends upwardly from one end of the rear shelf fold line 74 to the opposite end. Each rear shelf panel 72 may be substantially rectangular, and may define a (preferably V-shaped) cutout 58 centrally located along its distal (rear) edge 80, i.e., along the top portion 80 of the cut line 78. A rear fold line (rear knockdown score) 18 may vertically bisect the rear panel 16.

The first blank 50 may include upwardly projecting front tabs 45, rear tabs 45 and side tabs 47. More specifically, each front shelf fold line 54 and each rear shelf fold line 74 may be interrupted by one or more substantially semicircular tab score lines 43 to create one or more front tabs 45 and one or more rear tabs 45. Each side shelf fold line 62 may be interrupted by one or more substantially semicircular side tab score lines 49 to create one or more side tabs 47.

During assembly of the hutch 10, the two support halves 88 are glued to the first blank 50 in the positions indicated by the dashed lines 89 in FIG. 2.

The topmost side shelf panel 46 of each side panel 14 may define one or more slots 71 configured to receive the tabs 45 extending from the distal edge 60 of the topmost front shelf panel 44 and the tabs 45 extending from the distal edge 80 of the topmost rear shelf panel 72.

Second Blanks 88

Figure 3:
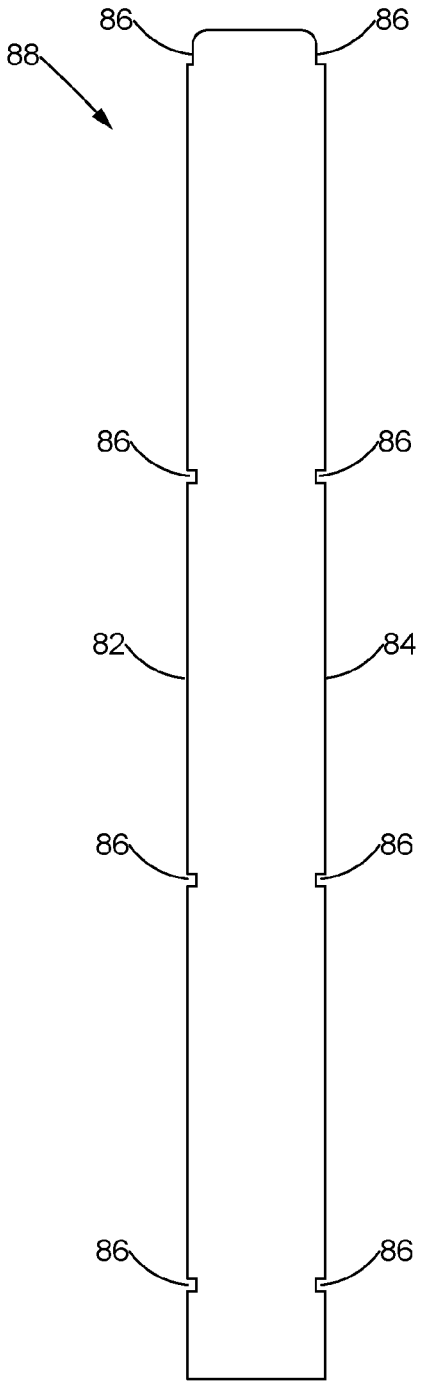
FIG. 3 is a plan view of a pair of second blanks used to make the display hutch of FIG. 1.

Two second blanks 88 may be used to form the internal support 20. Each second blank 88 may be substantially rectangular as shown in FIG. 3. Each second blank 88 may have a height at least as great as the distance between two of the glue tabs 66, and preferably at least as great as the distance between the bottommost glue tab 66 and the topmost glue tab 66. Each second blank 88 may have a vertical front edge 82 and a vertical rear edge 84. The front edges 82 of two blanks 88 come together in the assembled display hutch 10 to form the front edge 82 of the internal support 20. Likewise, the rear edges 84 of two blanks 88 come together in the assembled display hutch 10 to form the rear edge 84 of the internal support 20. The front edge 82 and the rear edge 84 each define a series of vertically spaced apart notches 86. The notches 86 align with and engage V-shaped cutouts 58 in the front shelf panels 44 and in the rear shelf panels 72 in the assembled hutch 10.

Method of Assembly

A method of assembling the hutch 10 will now be described with reference to FIGS. 2-10.

Glue or other adhesive is applied to the interior (support half 88 facing) surfaces of the glue tabs 66 or, less preferably, to areas of the support halves 88 that will be adhered to the glue tabs 66. After applying the glue, the two support halves 88 are positioned onto the first blank 50 in the locations indicated by the dashed lines 89 in FIG. 2. This causes the support halves 88 to become affixed to the vertically aligned glue tabs 66 of each side panel 14 to achieve the substantially flat structure 90 shown in FIG. 4.

Figure 4:
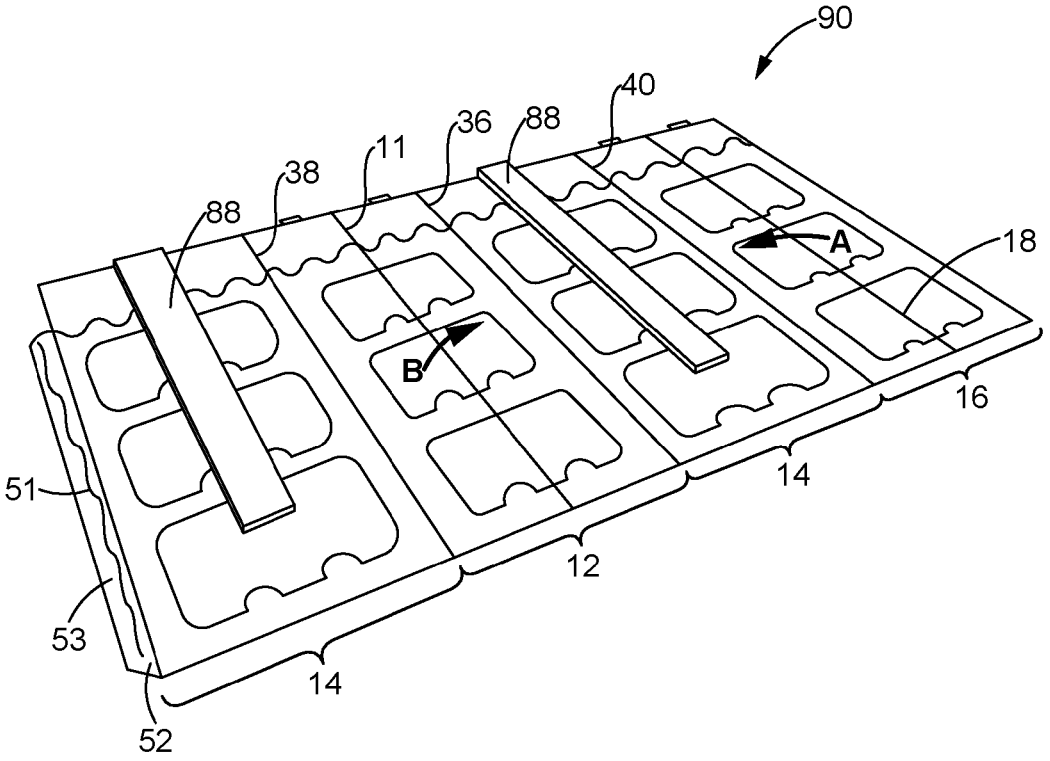
FIG. 4 is a perspective view of two second banks being affixed to the first blank to create a flat structure.

As shown in FIG. 4, glue 51 or other adhesive may be applied to the inner facing surface 53 of the glue panel 52. The flat structure 90 may be folded over along the rear knockdown score 18 as shown by arrow A in FIG. 4 and then folded over along the front knockdown score 11 as shown by arrow B until the glue panel 52 lays flat against the outer facing surface of the rear panel 16 and is adhered thereto to form the glued structure 92 of FIG. 5.

Alternatively, the flat structure 90 of FIG. 4 may be folded over along the third fold line 40 and then folded over along the second fold line 38 until the glue panel 52 lays flat against the outer facing surface of the rear panel 16 and is adhered thereto to form the glued structure 92.

Figure 5:
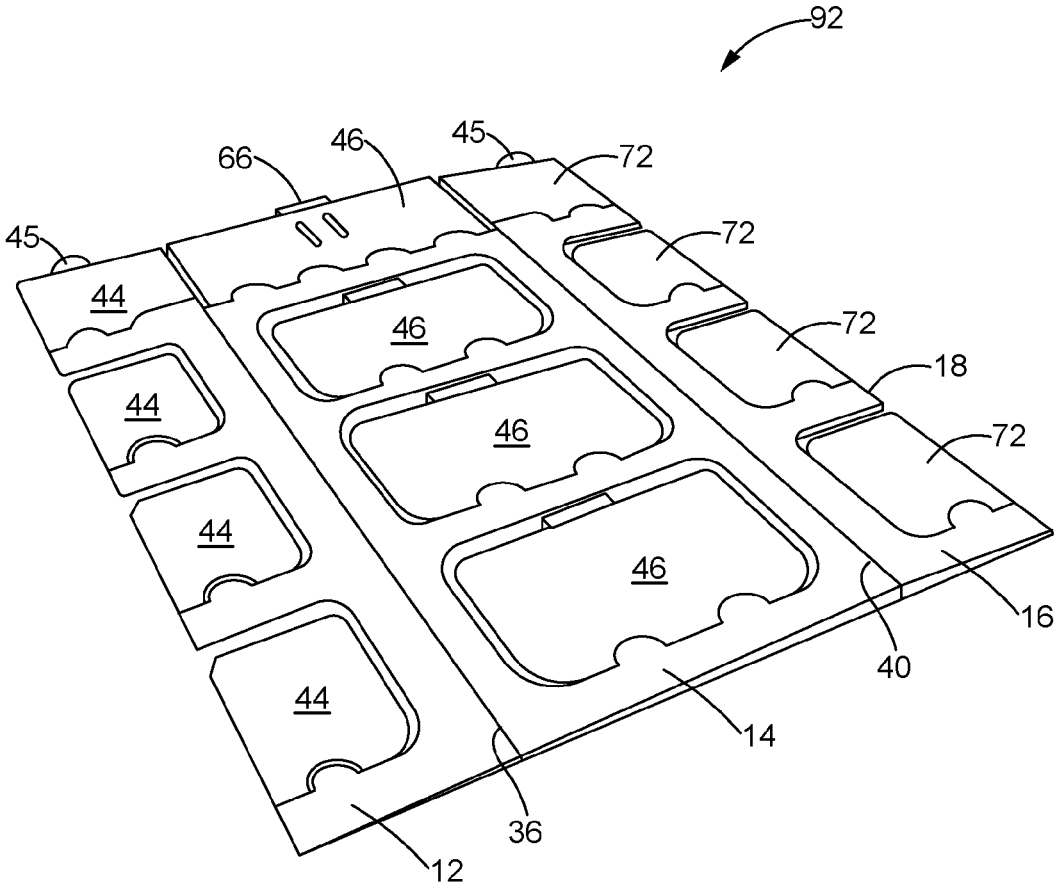
FIG. 5 is a perspective view of the flat structure of FIG. 3 after being folded and glued.

The glued structure 92 may be shipped in the configuration shown in FIG. 5. If desired, the glued structure 92 may be made even more compact. This may be achieved by squaring up (opening up) the structure 92 of FIG. 5 so that it assumes a three dimensional rectangular column shape (like that shown in FIG. 7), then pushing the front panel 12 inwardly along front knockdown score 11 and pushing the rear panel 16 inwardly along rear knockdown score 18. This pushing/folding step will cause the front panel 12 and the rear panel 16 to fold inwardly on themselves and become sandwiched between the side panels 14 to achieve the compact structure 94 shown in FIG. 6. The compact structure 94 has a width about the same as a single side panel 14 and is much more compact than most traditional hutches. The compact structure 94 may be shipped to the end user in this configuration.

Figure 6:
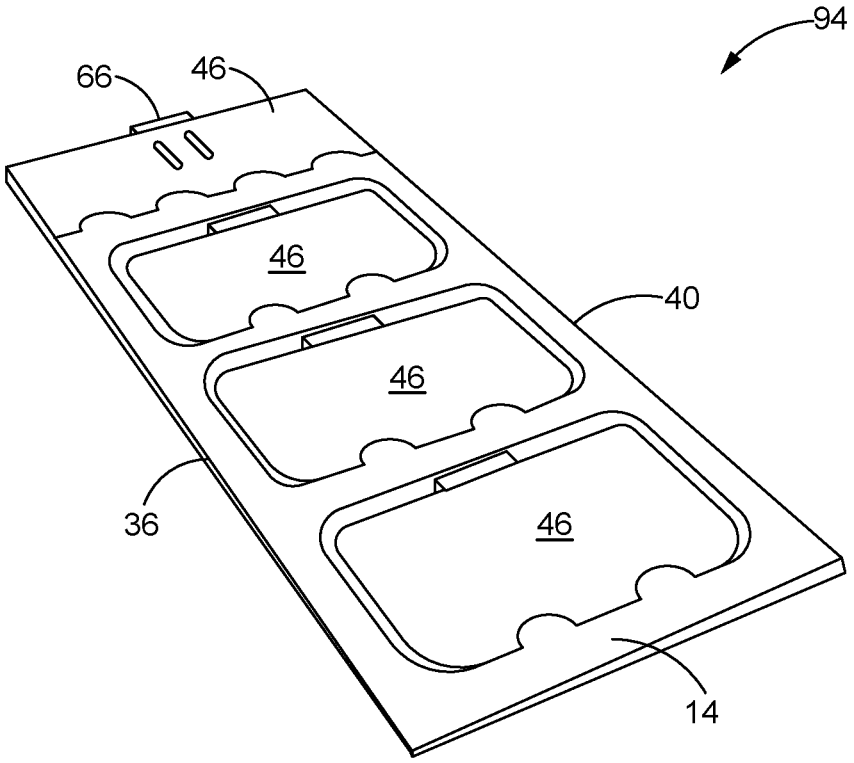
FIG. 6 is a perspective view of the structure of FIG. 5 after being further folded to form a compact structure.
Figure 7:
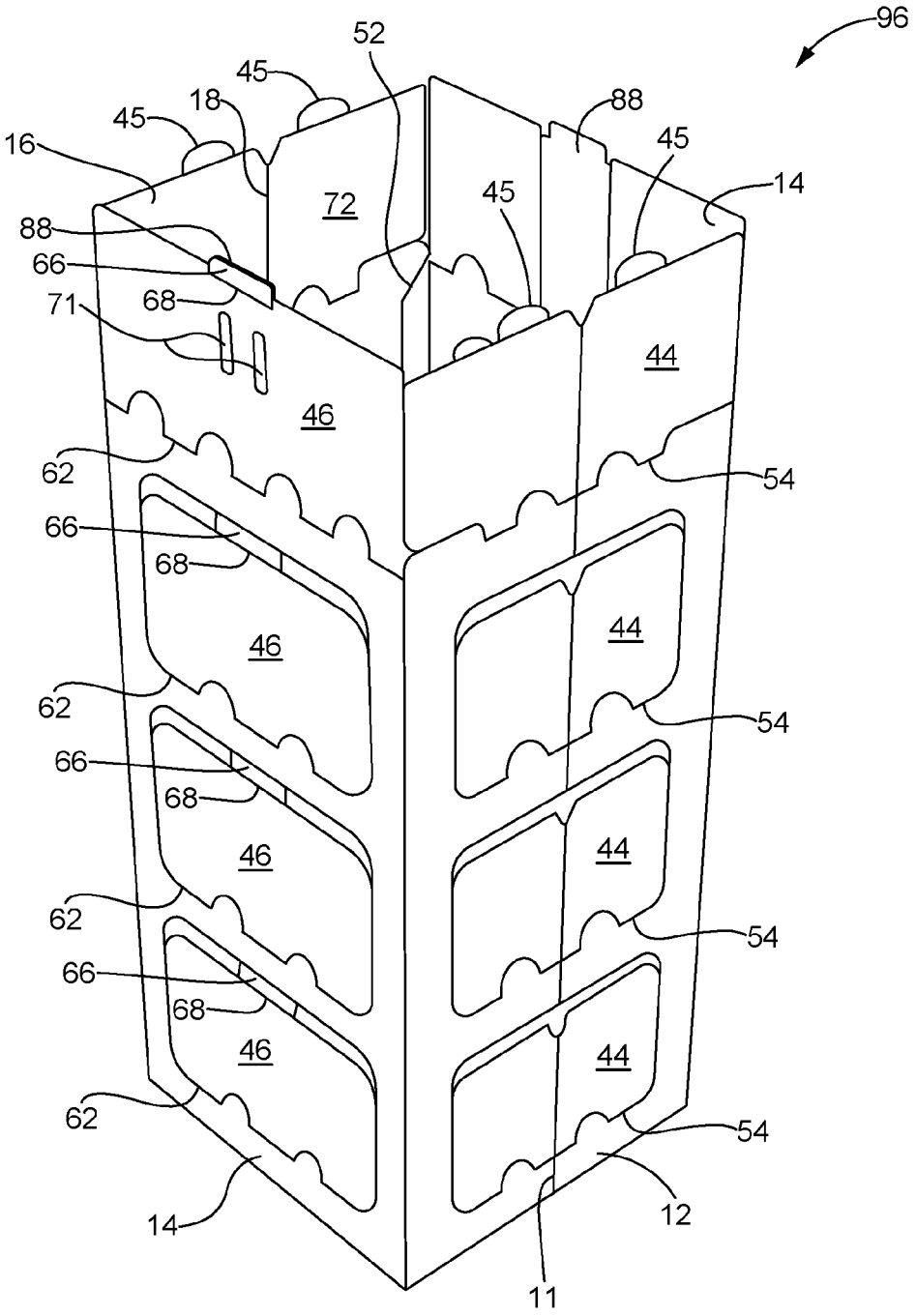
FIG. 7 is a front perspective view of the structure of FIG. 6 after being positioned upright and unfolded ("squared up") to create an upright structure.

To set up the hutch 10 at, for example, its final destination, starting with the compact structure 94 of FIG. 6, the compact structure 94 may be positioned upright and the front panel 12 and the rear panel 16 pulled outwardly to form the "squared up" three-dimensional upright structure 96 of FIG. 7. In this configuration the support halves 88 are adhered to the side panels 14 and are spaced apart by approximately the width of the structure 94.

Figure 8:
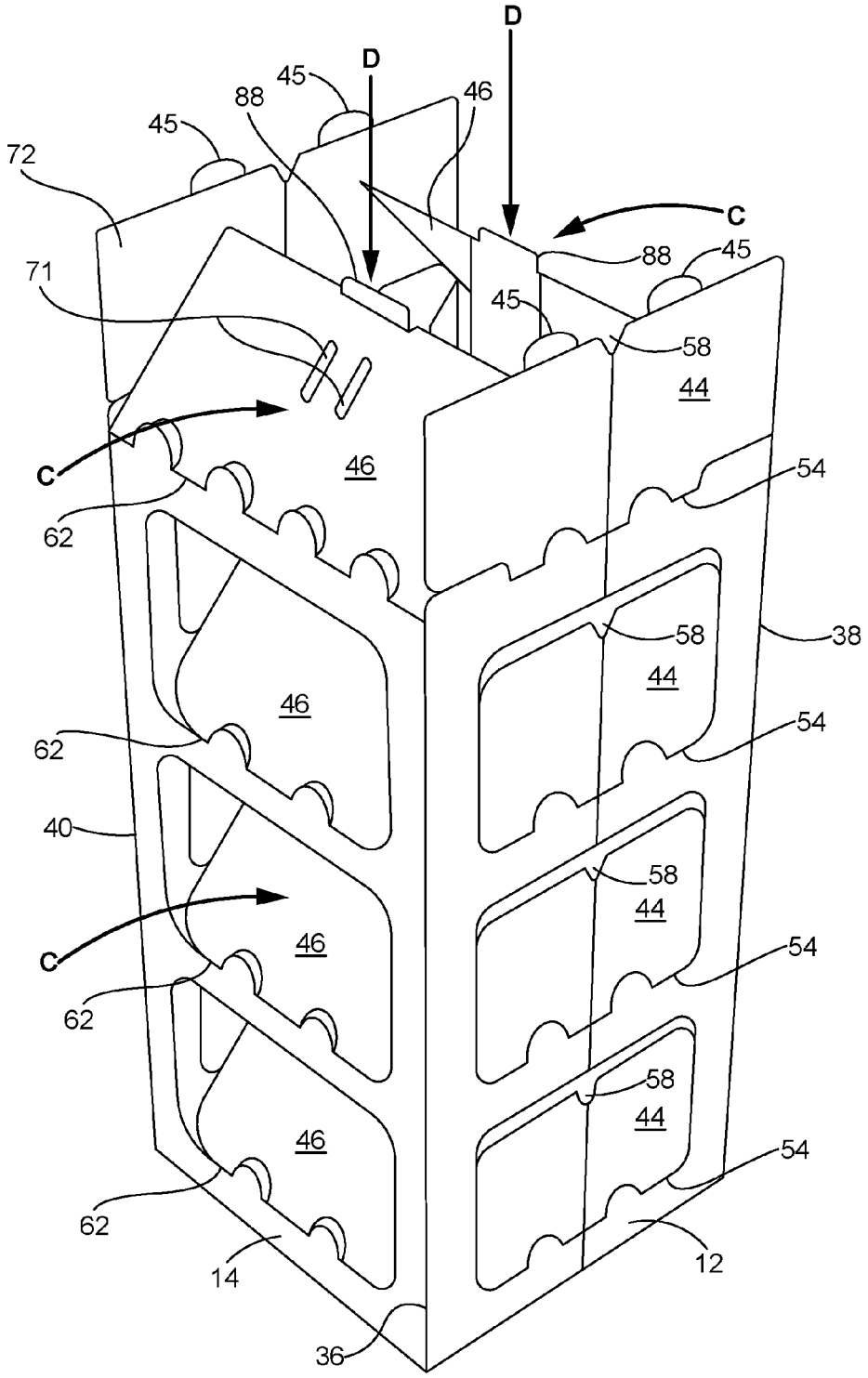
FIG. 8 is a front perspective view of the upright structure of FIG. 7 showing the side shelf panels being rotated into place.

Next, the side shelf panels 46 of each side panel 14 may be rotated downwardly along sixth fold lines 62 in unison. This may be accomplished by pushing inwardly and downwardly any of the side shelf panels 46 along its respective fold line 62 in the direction of arrow C in FIG. 8, and/or by pushing down on the support halves 88 in the direction of arrow D. FIG. 8 is a front perspective view of the upright structure of FIG. 7 showing the side shelf panels 46 of each side panel 14 being rotated downwardly. This action brings together the two support halves 88 to form a single internal support 20 as shown in FIG. 9.

Figure 9:
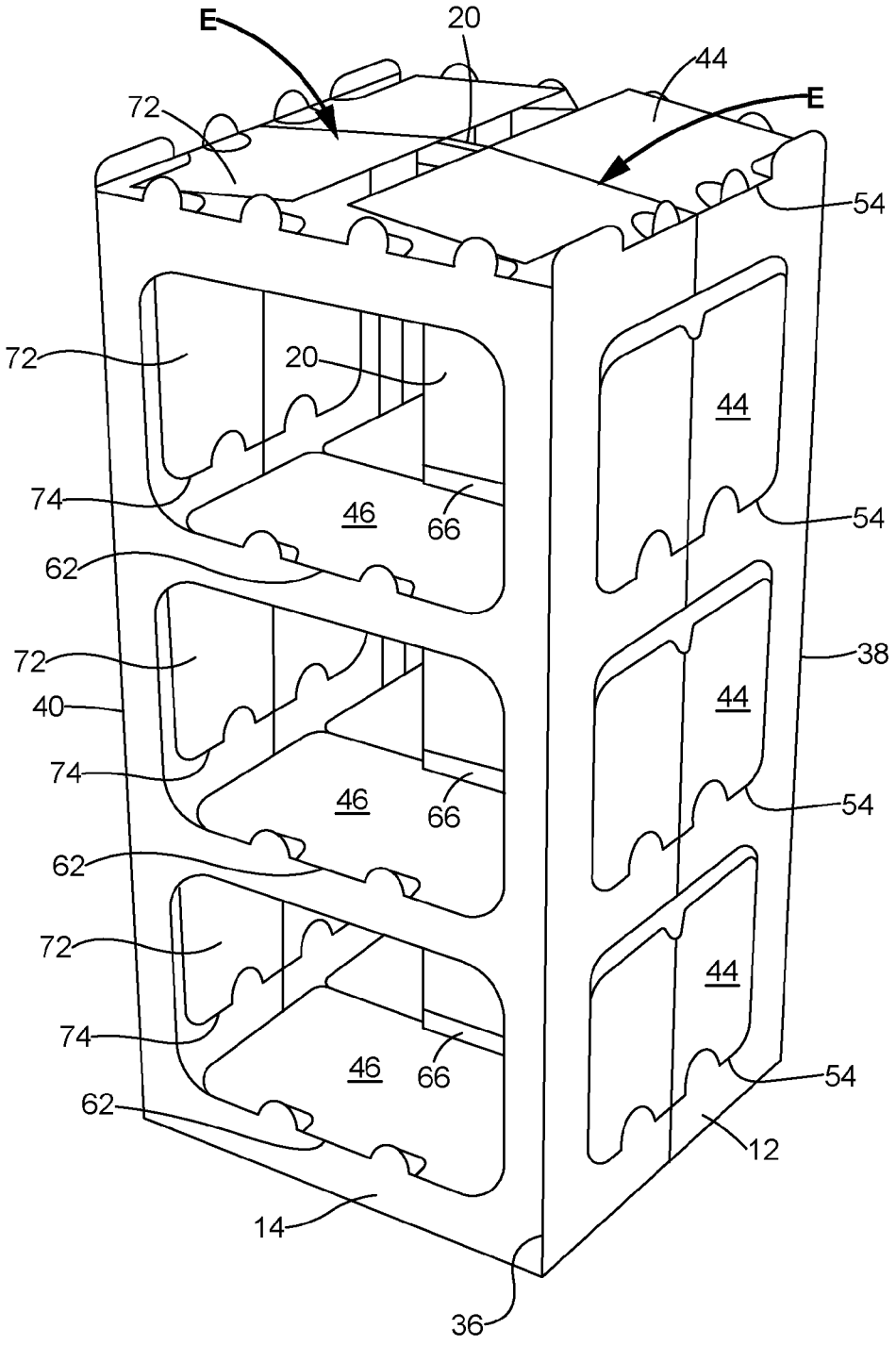
FIG. 9 is a front perspective view of the upright structure of FIG. 8 after all the side shelf panels have been rotated into place and showing the topmost front and rear shelf panels being rotated into place.

FIG. 9 is a front perspective view of the upright structure 96 of FIG. 8 after the side shelf panels 46 have been folded downward into a horizontal orientation.

Figure 10:
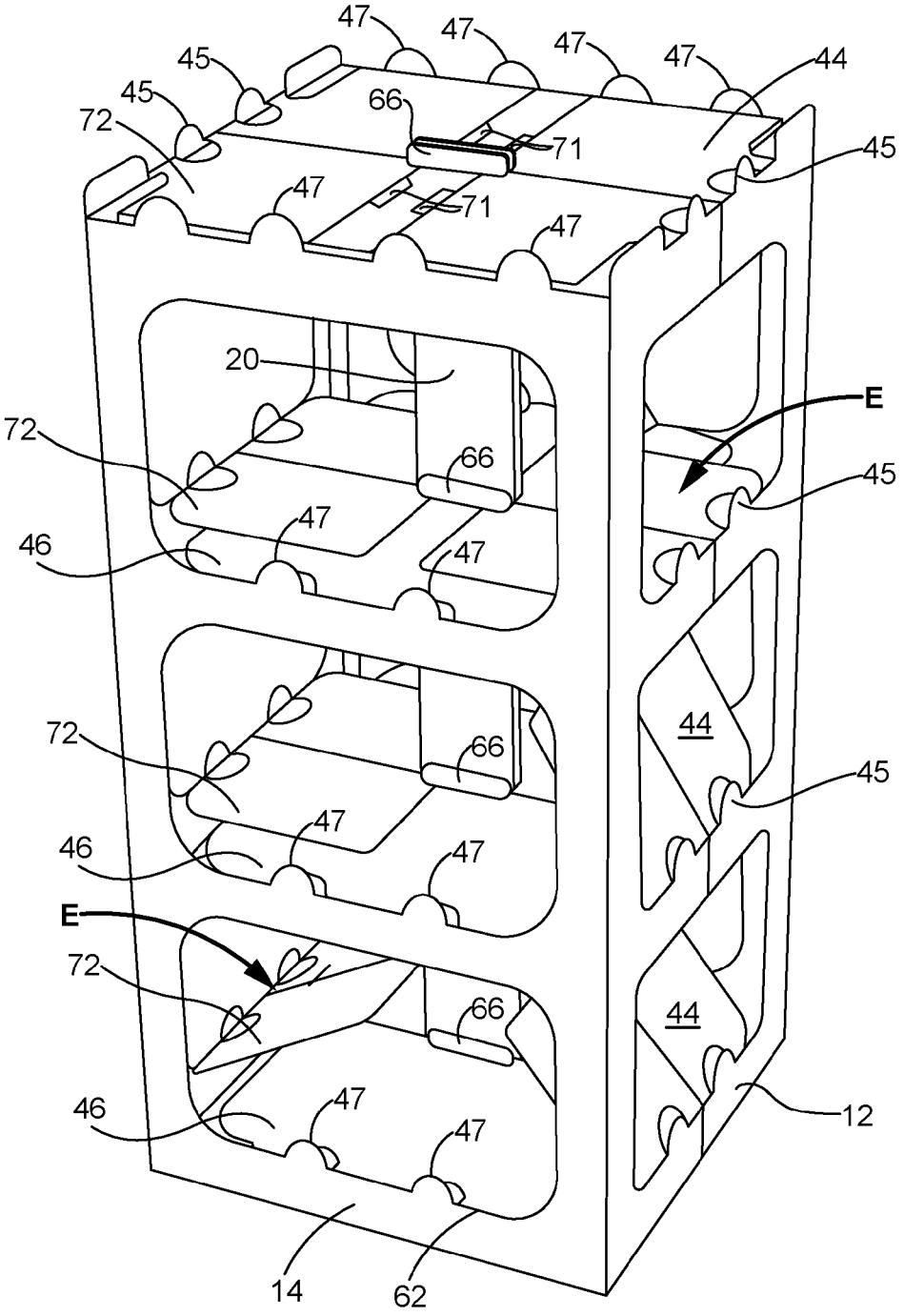
FIG. 10 is a rear perspective view of the upright structure of FIG. 9 showing the remaining front and rear shelf panels being rotated into place.

Finally, each front shelf panel 44 and each rear shelf panel 72 is pushed down individually in the direction of arrow E in FIG. 9 and FIG. 10 until the front shelf panels 44 and rear shelf panels 72 are in a horizontal orientation and the cutouts 58 of each front shelf panel 44 and each rear shelf panel 72 are locked into one of the notches 86 in the internal support 20. The display 10 is now fully assembled and appears substantially like the hutch 10 of FIG. 1.

INDUSTRIAL APPLICABILITY

The hutch 10 can be used to display any suitable product, in a retail setting or otherwise. The hutch is durable and can bear significant loads, especially if made of corrugated board. With knockdown scores on the front and rear panels, the hutch 10 can be folded into a compact configuration about half the size of some traditional hutches. Pillars along each corner and an internal support provide five vertical supports to hold products securely. The support halves 88 can be used to pull down the side shelf panels for fast and easy assembly. Together, the support halves 88 provide support at the center of each shelf 22.

It should be understood that the embodiments described above are only particular examples which serve to illustrate the principles of the invention. Modifications and alternative embodiments of the invention are contemplated which do not depart from the scope of the invention as defined by the foregoing teachings and appended claims. It is intended that the claims cover all such modifications and alternative embodiments that fall within their scope.

The invention claimed is:

1. A display hutch comprising:

a front panel comprising a front panel body that defines a plurality of windows and one or more front shelf panels rotatably attached to the front panel body along front shelf fold lines, the front panel extending from a left front corner edge to a right front corner edge;

a left side panel extending from the left front corner edge to a left rear corner edge, the left side panel comprising a left side panel body and one or more left side shelf panels, each left side shelf panel rotatably attached to the left side panel body along a side shelf fold line, the left side panel further comprising a left side glue tab hingedly attached to each left side shelf panel along a glue tab fold line;

a right side panel extending from the right front corner edge to a right rear corner edge, the right side panel comprising a right side panel body and one or more right side shelf panels, each right side shelf panel rotatably attached to the right side panel body along a side shelf fold line, the right side panel further comprising a right side glue tab hingedly attached to each right side shelf panel along a glue tab fold line;

a rear panel extending from the left rear corner edge to the right rear corner edge, the rear panel comprising a rear panel body that defines a plurality of windows and one or more rear shelf panels rotatably attached to the rear panel body along rear shelf fold lines;

one or more shelves, each shelf comprising one of the front shelf panels, one of the rear shelf panels and two of the side shelf panels; and an internal support comprising left and right support halves, the left support half adhered to each left side glue tab and the right side support half adhered to each right side glue tab.

2. The display hutch of claim 1 further comprising front tabs projecting upwardly from each front shelf fold line, rear tabs projecting upwardly from each rear shelf fold line, and side tabs projecting upwardly from each side shelf fold line.

3. The display hutch of claim 1 wherein each front shelf panel has a distal edge opposite the front shelf fold line that contacts and is supported by the internal support and each rear shelf panel has a distal edge opposite the rear shelf fold line that contacts and is supported by the internal support.

4. The display hutch of claim 1 wherein the internal support defines vertically spaced apart notches along a front edge and along a rear edge, each front shelf panel defines a cutout at its distal edge that engages one of the internal support notches along the front edge of the internal support, and each rear shelf panel defines a cutout at its distal edge that engages one of the internal support notches along the rear edge of the internal support.

5. The display hutch of claim 1 wherein the internal support is located equidistant the front panel and the rear panel and equidistant the two side panels.

6. The display hutch of claim 1 wherein the front panel, the left side panel, the right side panel, the rear panel and the shelves are formed from a single folded unitary first blank.

7. The display hutch of claim 6 wherein the internal support is formed from two second blanks.

8. The display hutch of claim 1 wherein the front panel is vertically bisected by a front fold line and the rear panel is vertically bisected by a rear fold line.

9. The display hutch of claim 1 further comprising a glue panel foldably attached to a panel selected from the group consisting of the front panel, the left side panel, the right side panel and the rear panel, and wherein the glue panel is affixed to a different panel selected from the group consisting of the front panel, the left side panel, the right side panel and the rear panel.

10. The display hutch of claim 1 wherein the display hutch extends upward from a ground-contacting bottom edge and the internal support extends downward to the ground.

11. A method of assembling the display hutch of claim 9 comprising the steps of:

adhering one support half to the glue tabs of the left side panel and adhering the other support half to the glue tabs of the right side panel;

adhering the glue panel to the rear panel to create a folded and glued structure;

positioning the folded and glued structure in an upright position and squaring up the structure;

rotating downwardly in unison the side shelf panels of each side panel along the side shelf fold lines until the support halves about each other;

rotating downwardly each front shelf panel about its front shelf fold line until each front shelf panel is in a horizontal orientation; and rotating downwardly each rear shelf panel about its rear shelf fold line until each rear shelf panel is in a horizontal orientation.

* * * * *